US007175491B1

(12) United States Patent
Davis et al.

(10) Patent No.: US 7,175,491 B1
(45) Date of Patent: Feb. 13, 2007

(54) ASSEMBLY SYSTEM FOR A MARINE PROPULSION DEVICE

(75) Inventors: Richard A. Davis, Mequon, WI (US); Claus Bruestle, Fond du Lac, WI (US); Wayne M. Jaszewski, Jackson, WI (US); George E. Phillips, Oshkosh, WI (US); John M. Griffiths, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/120,569

(22) Filed: May 3, 2005

(51) Int. Cl.
*B63H 21/30* (2006.01)

(52) U.S. Cl. ..... 440/111

(58) Field of Classification Search ..... 440/112, 440/111, 53, 57
See application file for complete search history.

(56) References Cited

U.S. PATENT DOCUMENTS

| | | | | | |
|---|---|---|---|---|---|
| 190,312 | A * | 5/1877 | Gray et al. | 440/112 |
| 2,064,463 | A * | 12/1936 | Crosley, Jr. | 440/83 |
| 2,392,834 | A * | 1/1946 | Clement, Jr. | 114/358 |
| 2,738,751 | A * | 3/1956 | Hogberg | 440/52 |
| 2,909,031 | A * | 10/1959 | Kiekhaefer | 60/320 |
| 3,057,320 | A * | 10/1962 | Daniels | 440/62 |
| 3,498,253 | A * | 3/1970 | Wood, Jr. | 440/6 |
| 3,669,057 | A | 6/1972 | Shimanckas | 115/34 R |
| 4,178,873 | A | 12/1979 | Bankstahl | 115/73 |
| 4,297,097 | A | 10/1981 | Kiekhaefer | 440/59 |
| 4,362,514 | A | 12/1982 | Blanchard | 440/61 |
| 4,634,391 | A | 1/1987 | Entringer et al. | 440/75 |
| 4,678,440 | A * | 7/1987 | Rodrigue et al. | 440/53 |
| 4,752,256 | A * | 6/1988 | Dorion | 440/49 |
| 4,872,531 | A | 10/1989 | Meisenburg et al. | 184/6.4 |
| 4,881,370 | A * | 11/1989 | Sakurai et al. | 60/310 |
| 4,897,057 | A | 1/1990 | McCormick | 440/57 |
| 4,940,434 | A | 7/1990 | Kiesling | 440/57 |
| 5,108,325 | A | 4/1992 | Livingston et al. | 440/112 |
| 5,514,013 | A * | 5/1996 | Rodskier | 440/57 |
| 6,186,845 | B1 | 2/2001 | Head | 440/57 |
| 6,296,535 | B1 | 10/2001 | Bland et al. | 440/61 |
| 6,305,997 | B1 | 10/2001 | Whiteside et al. | 440/57 |
| 6,454,620 | B1 | 9/2002 | Theisen et al. | 440/61 |
| 6,491,588 | B1 | 12/2002 | Mansfield et al. | 464/178 |
| 6,561,859 | B1 | 5/2003 | Towner et al. | 440/61 |
| 6,607,410 | B1 | 8/2003 | Neisen et al. | 440/57 |
| 6,609,939 | B1 | 8/2003 | Towner et al. | 440/111 |

FOREIGN PATENT DOCUMENTS

| | | |
|---|---|---|
| EP | 0296797 | * 12/1988 |

* cited by examiner

*Primary Examiner*—Ed Swinehart
(74) *Attorney, Agent, or Firm*—William D. Lanyi

(57) ABSTRACT

A marine propulsion system is configured to be assembled, as one unitary structure, into a marine vessel. A transom attachment member is provided and is attachable to both an engine and a drive unit to form a single marine propulsion system structure which can be lowered into an opening formed in a transom of a marine vessel.

5 Claims, 8 Drawing Sheets

ASSEMBLY SYSTEM FOR A MARINE PROPULSION DEVICE

BACKGROUND OF THE INVENTION

1. Field of the Invention

The present invention is generally related to a marine propulsion system and, more particularly, to a marine propulsion system that allows the engine and drive unit to be attached together prior to assembly into a marine vessel.

2. Description of the Related Art

Many different types of marine propulsion systems are known to those skilled in the art. These include sterndrive systems, inboard propulsion systems, and outboard motors. Sterndrive propulsion systems are assembled in a marine vessel by individually mounting the engine within the marine vessel, mounting the drive unit to an outer surface of a transom of the marine vessel, and then attaching the engine output shaft to an input shaft of the drive unit.

U.S. Pat. No. 4,634,391, which issued Entringer et al. on Jan. 6, 1987, discloses an engine coupler for a sterndrive. A coupling assembly for coupling the crankshaft of an inboard engine to the input shaft of an outboard propulsion unit has a coupling member stamped from steel. The coupling member is attached to the engine flywheel at three points at the vertices of the triangular coupling member base. An elastomeric annulus couples the coupling member to the input shaft.

U.S. Pat. No. 4,297,097, which issued to Kiekhaefer on Oct. 27, 1981, discloses a sterndrive mechanism. The sterndrive installation includes a mounting bracket assembly for securement to the transom of a watercraft. The bracket assembly is provided with a transverse horizontal bore rearwardly of the transom for receiving one end of the horizontal cylindrical portion of the upper housing of the drive unit. A bracket assembly addition is provided with a horizontal bore which rotatably receives the opposite end of the horizontal cylindrical portion of the upper housing and is secured to the bracket assembly.

U.S. Pat. No. 4,362,514, which issued to Blanchard on Dec. 7, 1982, describes a high performance sterndrive unit. A marine propulsion device comprises a bracket adapted to be fixed to a boat transom. It has an upper portion and a lower portion. A propulsion leg includes a rotatable mounted propeller. A first ball joint universally connects the propulsion leg and the lower bracket portion. A hydraulic cylinder-piston assembly has first and second ends. A pivot connects the first end of the hydraulic cylinder-piston assembly to the propulsion leg about an axis which is generally horizontal when the bracket is boat mounted.

U.S. Pat. No. 4,178,873, which issued to Bankstahl on Dec. 18, 1979, discloses an exhaust coupling assembly for a marine sterndrive. The drive includes an inboard engine having an exhaust passageway connected to an outboard drive unit having an exhaust passageway. A transom bracket assembly is positioned between the engine and the drive unit and permits vertical pivoting of the drive unit for steering and horizontal pivoting of the drive unit for trimming. The improvement includes a first exhaust pipe connected to the inboard engine and a second exhaust pipe connected to the drive unit.

U.S. Pat. No. 3,669,057, which issued to Shimanckas on Jun. 13, 1972, describes an inflatable transom ceiling arrangement. A boat hull has a transom having an aperture. A sterndrive unit is mounted on the boat hull and has a part extending through the transom aperture. A seal extends between the transom and the part and comprises a member which is inflated so as to sealingly circumferentially engage both the part and the transom to prevent passage of water through the aperture and around the part into the hull.

U.S. Pat. No. 6,491,588, which issued to Mansfield et al. on Dec. 10, 2002, describes an upper case housing support tower for a marine sterndrive unit. The support is a generally tubular member of high quality steel or steel alloy which is threaded at its lower end. The upper end carries an external flange. The upper end defines an internal taper which receives a bearing assembly. The flange is secured in the unit by a fastener and the threaded lower end is secured by a retainer such as a spanner nut. The driveshaft extends within the support substantially increasing the horsepower capacity of the unit by several times.

U.S. Pat. No. 6,607,410, which issued to Neisen et al. on Aug. 19, 2003, describes a single cylinder tilt-trim assembly for boats using a sterndrive system. The system includes a gimbal ring that defines an inner region. The gimbal ring is configured to pivotally receive a first anchor pin. A tilt-trim assembly is affixed to the outdrive and the tilt-trim assembly has one respective end thereof configured to pivotally receive a second anchor pin supported by the outdrive.

U.S. Pat. No. 6,305,997, which issued to Whiteside et al. on Oct. 23, 2001, describes a self-aligning universal joint assembly for a sterndrive. A U-joint includes an input shaft that receives driving power and an output shaft connectable to the drive unit. The assembly further uses an alignment subassembly configured to support the U-joint in an alignment position while its output shaft is being connected to the drive unit.

U.S. Pat. No. 4,940,434, which issued to Kiesling on Jul. 10, 1990, discloses a marine propulsion unit universal drive assembly with through-bellows exhaust. A pair of generally telescoped bellows surround the universal joint of a marine propulsion device and provide an exhaust passage therebetween which communicates between the inboard engine and the sterndrive unit. In an embodiment, the inner bellows rotates with the universal joint while the outer bellows is stationary.

U.S. Pat. No. 4,897,057, which issued to McCormick on Jan. 30, 1990, discloses a marine propulsion unit universal drive assembly. A flexible bellows surrounds the universal joint disposed between a marine engine and a sterndrive unit. It is mounted to rotate with the universal joint itself. The universal joint is disposed within a chamber delineated by the bellows itself and by end caps mounted to the universal joint shafts.

U.S. Pat. No. 6,296,535, which issued to Bland et al. on Oct. 2, 2001, describes a tilt-trim subsystem for boats using a sterndrive system. The subsystem assembly is affixed to an outdrive of a sterndrive that may be supported by a gimbal unit and may be configured to rotate about a predetermined axis to impart a desired trim or tilt to the drive system. The tilt-trim assembly has one respective end thereof configured to pivotally receive one anchor pin supported by the outdrive. The assembly includes one or more cylinders having one end thereof pivotally connected to another anchor pin so that when the cylinder is actuated the outdrive and the tilt-trim subsystem assembly are jointly rotated about the predetermined axis.

U.S. Pat. No. 6,454,620, which issued to Theisen et al. on Sep. 24, 2002, discloses an integrated external hydraulic trimming and steering system for an extended sterndrive transom assembly. A marine propulsion system is provided with a drive unit that is attachable to a transom of a marine vessel and provided with steering cylinder assemblies and trimming cylinder assemblies which are connected to a common location on a structural member, such as a gimbal ring.

U.S. Pat. No. 4,872,513, which issued to Meisenburg et al. on Oct. 10, 1989, discloses a marine sterndrive with a through-housing lubrication system. It includes an assemblage of a propeller carrying driveshaft housing, a bell housing and gimbal housing. Mating flow through passages are disposed in the driveshaft housing and bell housing, and a dual control valve system joins the passages at their juncture.

U.S. Pat. No. 6,561,859, which issued to Towner et al. on May 13, 2003, describes a marine engine assembly arm yoke and trunnion assembly. A steering arm yoke and trunnion assembly for a marine propulsion system includes a steering arm and a yoke including integral fluid paths for trim actuator fluids and for cooling water for an outboard powerhead mounted to a horizontal mounting plate within a platform extending from a boat hull. The steering arm and yoke include a drum extending through the horizontal mounting plate for rotating an attached propeller drive unit.

U.S. Pat. No. 6,186,845, which issued to Head on Feb. 13, 2001, describes a motor mounting structure for a boat. A mount for an outboard motor is disclosed in which the cylinder block of the motor is within the hull and the gear box and propeller are outside the hull. The driveshaft passes through the mount from the block to the gear box. The mount permits the motor to be swung from a horizontal axis to raise and lower the propeller.

U.S. Pat. No. 5,108,325, which issued to Livingston et al. on Apr. 28, 1992, discloses a boat propulsion device. The device is intended for a boat and mounts through a hole in a bottom surface of the boat. The engine is positioned inside the boat and the propeller drive is positioned under a bottom surface of the boat. The propulsion device includes a mounting assembly, a steering assembly rotatably connecting the drive to the mounting assembly for steering the propeller drive under the boat, a trimming assembly swingingly connecting the drive to the steering assembly for trimming/tilting of the propeller drive under the boat at any steering position, and a driveshaft means providing a drive connection between the engine and the propeller drive at any steered and trimmed position.

U.S. Pat. No. 6,609,939, which issued to Towner et al. on Aug. 26, 2003, describes a marine engine mounting assembly for a marine propulsion system. It includes a horizontal mounting plate, a pivot housing, and an adapter plate attached to one another through a plurality of vibration absorbing isolation points.

The patents described above are hereby expressly incorporated by reference in the description of the present invention.

It would be significantly beneficial if a sterndrive marine propulsion system could be preassembled and subsequently attached to a marine vessel as a unit, wherein the unit comprises the engine, the drive unit, and a transom attachment member.

SUMMARY OF THE INVENTION

A marine propulsion system made in accordance with a preferred embodiment of the present invention comprises an engine, a drive unit, and a transom attachment member. The engine and drive unit are attachable to the transom attachment member prior to attachment of the transom attachment member to a transom of a marine vessel. The transom attachment member is attachable to the transom of the marine vessel while the engine and drive unit remain attached to the transom attachment member.

In a particularly preferred embodiment of the present invention, the transom attachment member is shaped to be received in an opening formed in a transom of a marine vessel. The opening extends through an upper edge of the transom. The opening is shaped to receive the transom attachment member as the transom attachment member is lowered into the opening from a position above the transom in a particularly preferred embodiment of the present invention.

A first rotatable shaft extends from the engine and is connected in torque transmitting relation with a second rotatable shaft that extends from the drive unit. The first and second rotatable shafts are rotatable about a common axis of rotation which extends through the transom attachment member when the engine and drive unit are attached to the transom attachment member.

The transom attachment member has a channel formed therein which is shaped to receive a portion of the transom therein. A transom plate can be attachable to the transom attachment member with the transom disposed therebetween.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
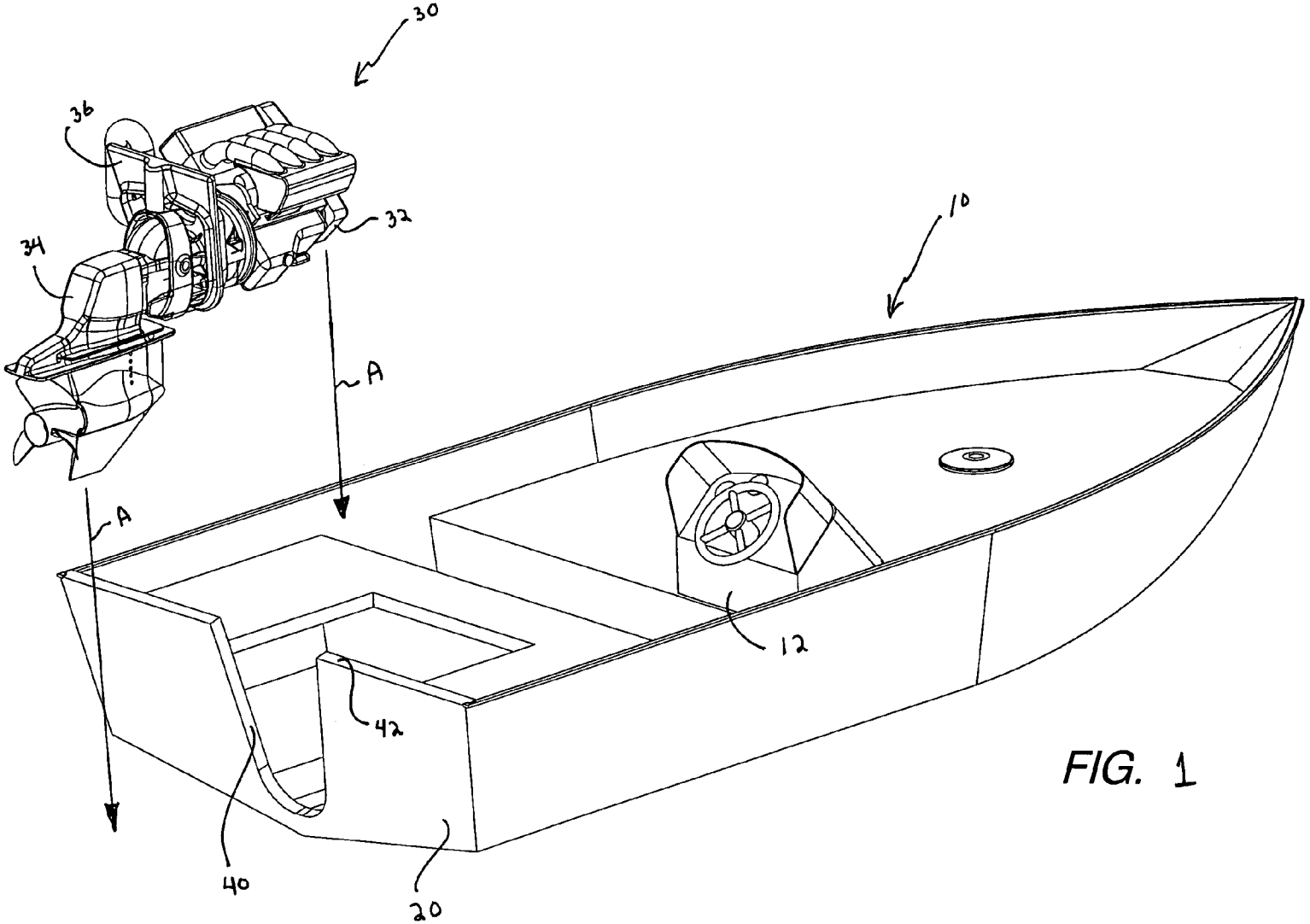
FIG. 1 is an exploded isometric view of a marine propulsion system and a marine vessel.

Throughout the description of the preferred embodiment of the present invention, like components will be identified by like reference numerals.

FIG. 1 illustrates a marine vessel 10. For purposes of reference, a helm location 12 and a transom 20 are identified. A marine propulsion system 30 comprises an engine 32, a drive unit 34, and a transom attachment member 36. The engine 32 and the drive unit 34 are attachable to the transom attachment member 36 prior to attachment of the transom attachment member 36 to the transom 20 of the marine vessel. The transom attachment member 36 is attachable to the transom 20 of the marine vessel 10 while the engine 32 and the drive unit 34 remain attached to the transom attachment member 36 as shown in FIG. 1.

The transom attachment member 36 is shaped to be received in an opening 40 which is formed in the transom 20 of the marine vessel 10. The opening 40 extends through an upper edge 42 of the transom 20. The opening 40 is shaped to receive the transom attachment member 36 as the transom attachment member 36 is lowered, as represented by arrows A, into the opening 40 from a position above the transom, as illustrated in the exploded view of FIG. 1.

Figure 2:
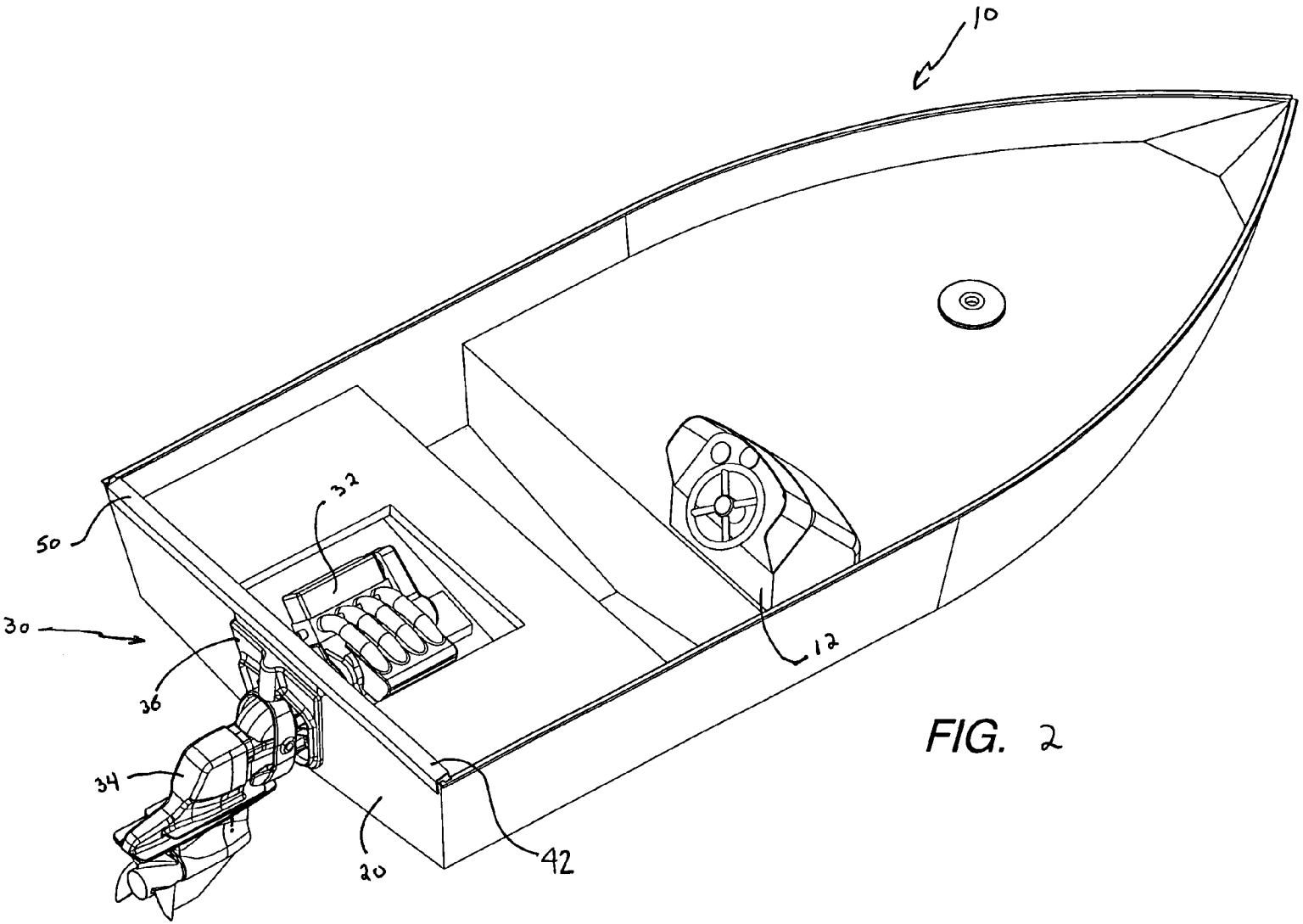
FIG. 2 is an assembled view of the marine propulsion system within the marine vessel illustrated in FIG. 1.

FIG. 2 illustrates the marine vessel 10 after the marine propulsion system 30, including the engine 32, the drive unit 34, and the transom attachment member 36, is lowered into position with the transom attachment member 36 attached to the transom 20 of the marine vessel 10. After the assembly of the marine propulsion system 30 in the marine vessel 10, a cap member 50 can be installed across the upper edge 42 of the transom 20 which is described above in conjunction with FIG. 1.

Figure 3:
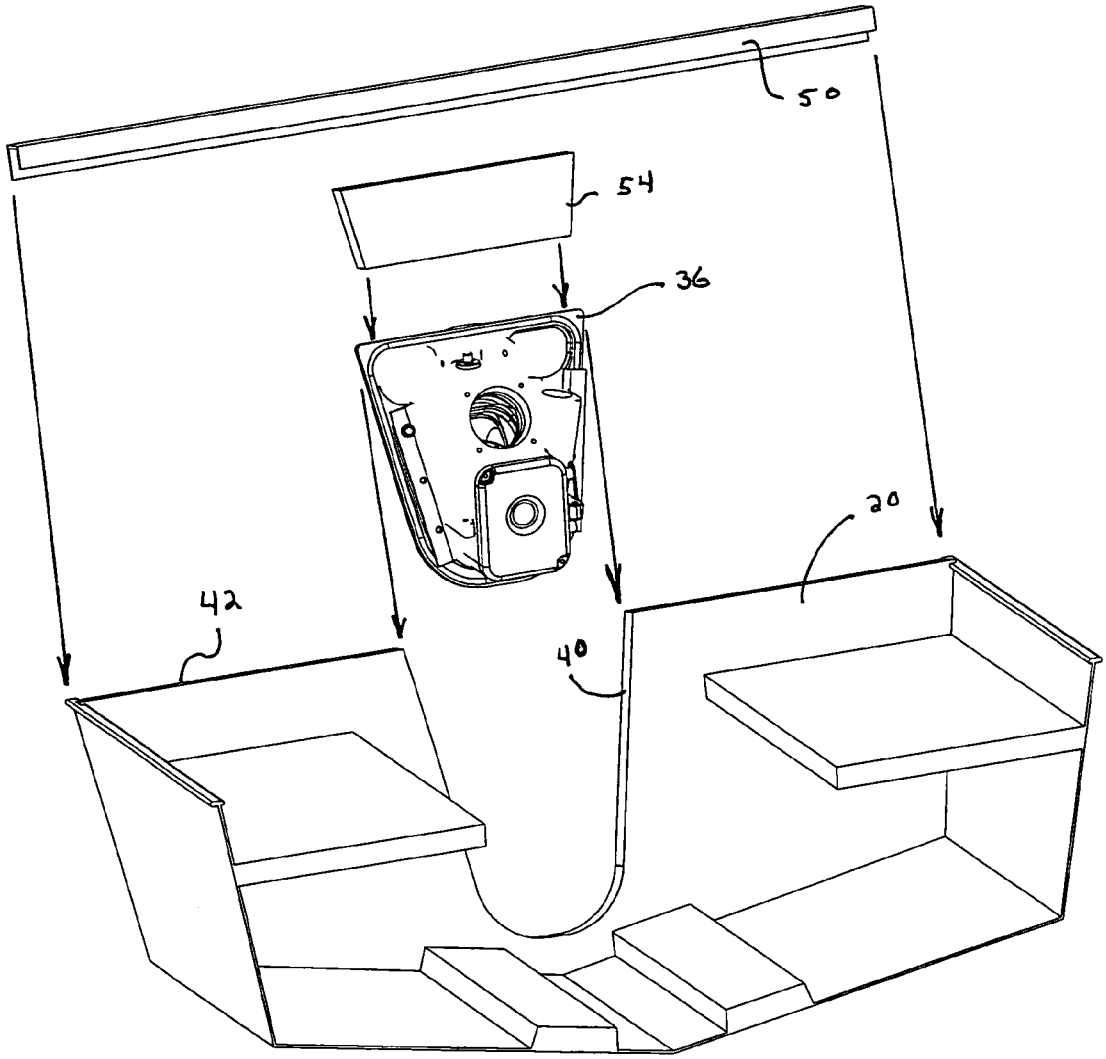
FIG. 3 is a partial view of a marine vessel showing the transom attachment member in an exploded view.

FIG. 3 is a partial view of the aft portion of the marine vessel 10, showing the opening 40 with the transom attachment member 36 in position above the opening 40. It should be understood that the illustration in FIG. 3 only shows the transom attachment member 36 for purposes of clarity, but the installation of the transom attachment member 36 into opening 40 is intended to occur with the engine 32 and drive unit 34 rigidly attached to each other and to the transom attachment member 36. The illustration in FIG. 3 is intended to show the relationship between the transom attachment member 36 and the opening 40. It is also intended to show the relative positions of the cap 50 and filler piece 54.

Figure 4:
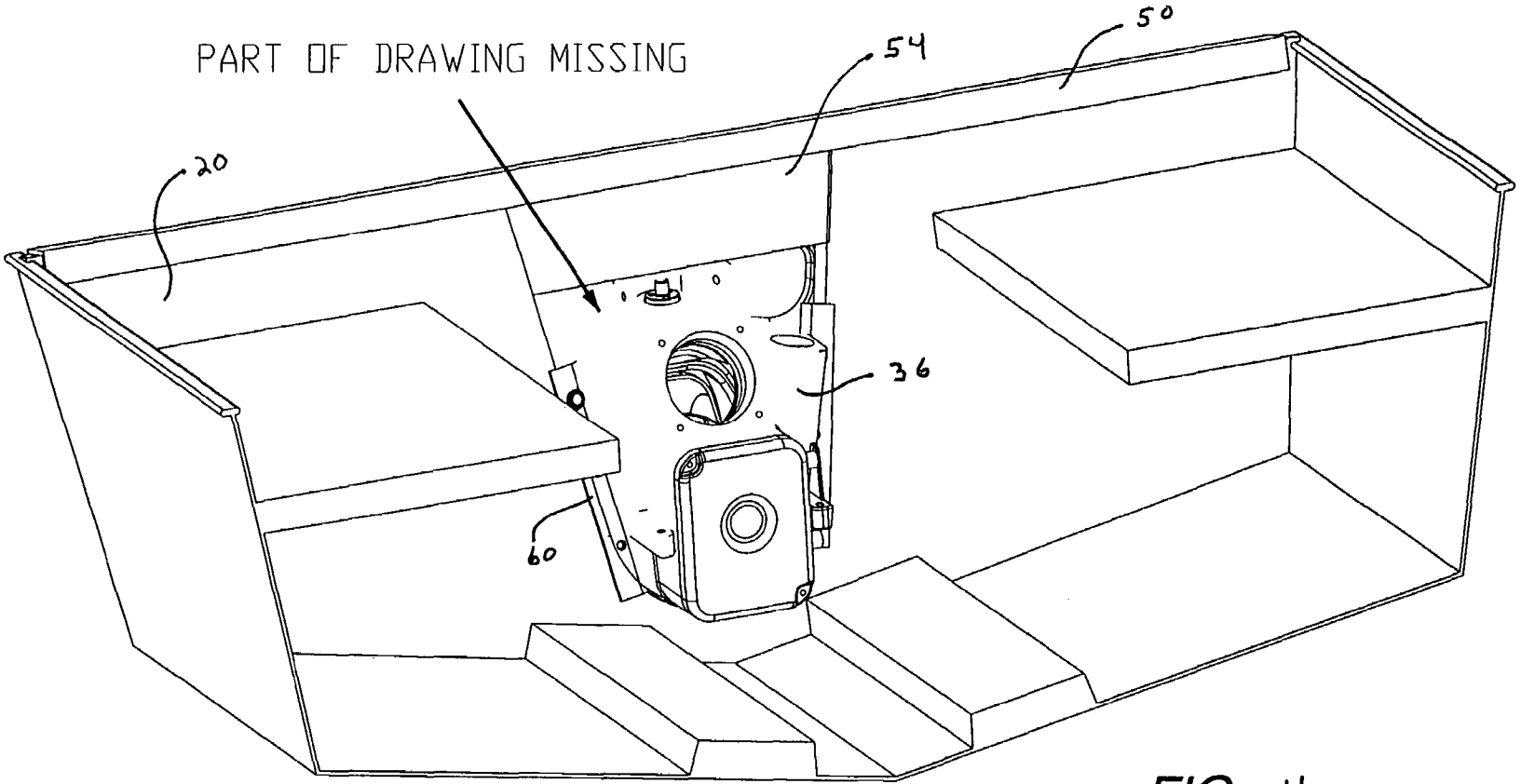
FIG. 4 is an assembled view of the structure shown in FIG. 3.

FIG. 4 shows the transom attachment member 36 located within the opening of a marine vessel with the filler piece 54 located above it and the cap 50 extending across the top edge of the transom 20. Also shown in FIG. 4 is a transom plate 60 which is used in conjunction with the transom attachment member 36 to attach the transom attachment member 36 to the transom 20. With reference to FIGS. 3 and 4, it should be clearly understood that although the illustrations only show a transom attachment member 36, the assembly procedure is intended to occur with the engine 32 and drive unit 34 rigidly attached to the transom attachment member 36 as it is lowered from the position shown in FIG. 3 to the position shown in FIG. 4.

Figure 5:
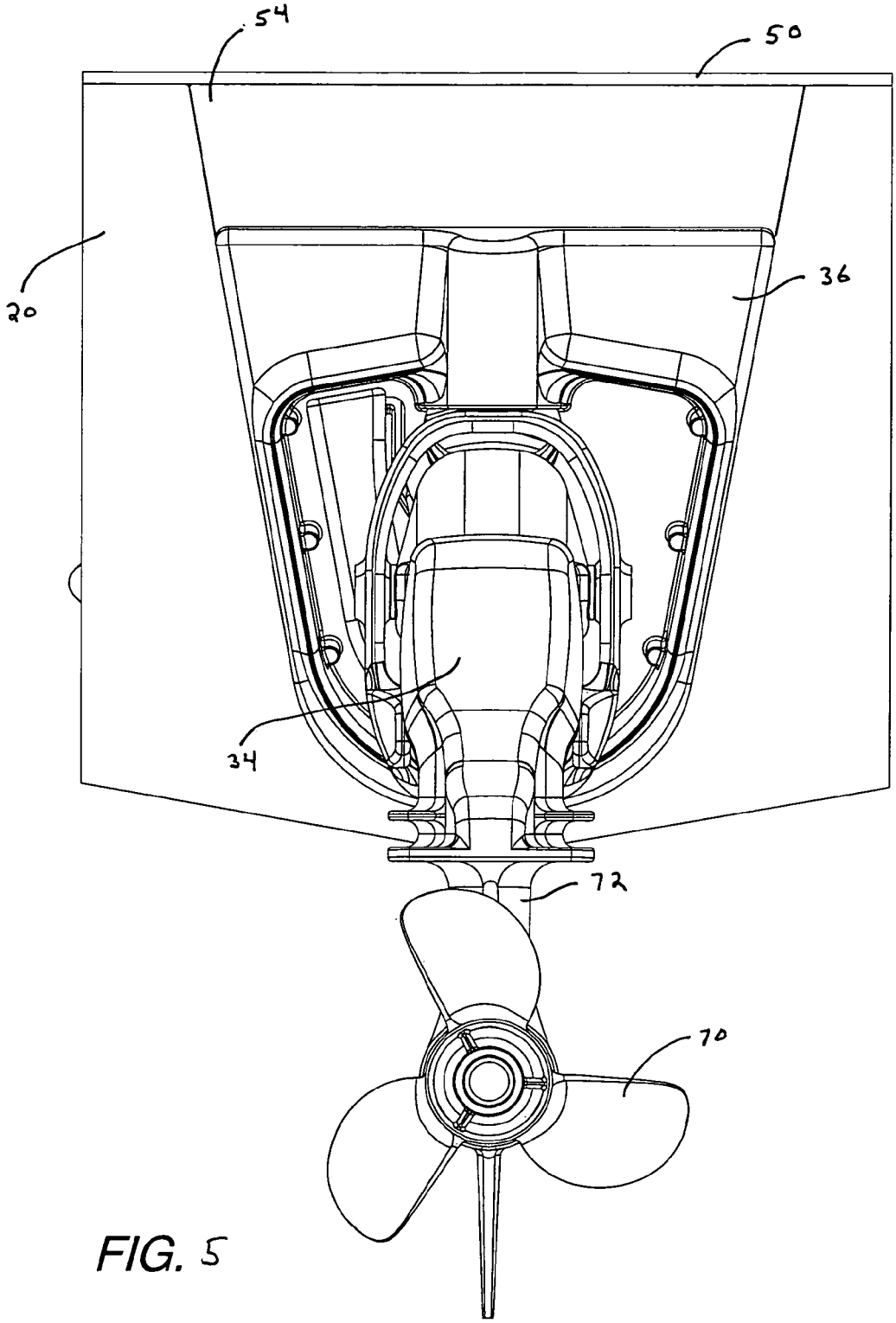
FIG. 5 is a rear view of the present invention assembled with a transom of a marine vessel.

FIG. 5 is a rear view of a portion of the transom 20 after the marine propulsion system is installed. In the view of FIG. 5, the drive unit 34 and the transom attachment member 36 are visible. Also shown in FIG. 5 is a propeller 70. As is well known to those skilled in the art, the propeller 70 is attached to a propeller shaft which is generally horizontal. The horizontal propeller shaft is attached to a generally vertical driveshaft contained within the driveshaft housing 72. The filler piece 54 and cap 50 are installed above the transom attachment member 36.

Figure 6:
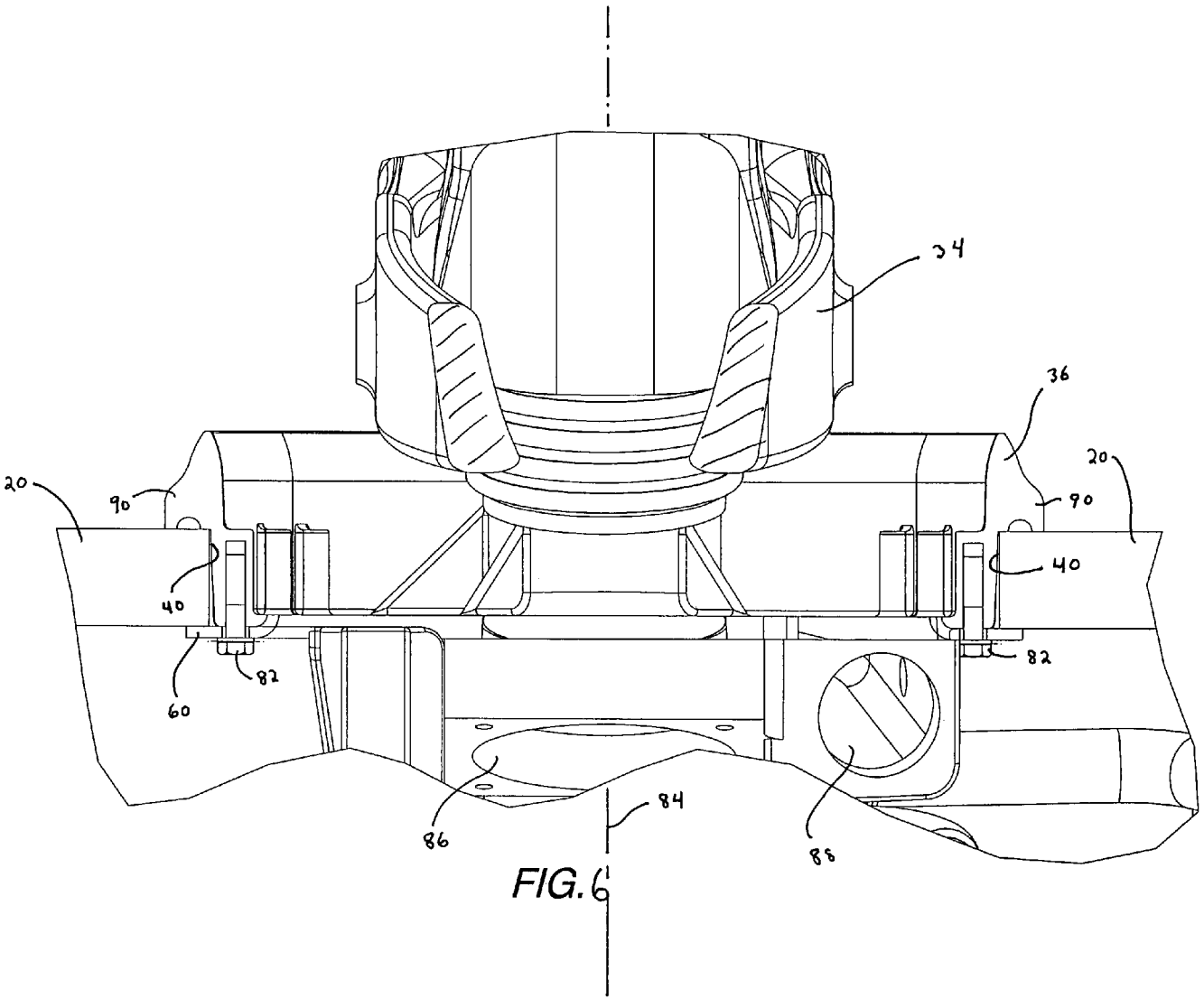
FIG. 6 is a partial section view of the transom attachment member and drive unit of the present invention attached to a transom of a marine vessel.

FIG. 6 is a partial section view of a drive unit 34 and a transom attachment member 36 attached to a transom 20 of a marine vessel. For purposes of clarity, the engine 32 is not shown in FIG. 6. However, it should be understood that the engine 32, as described above in conjunction with FIG. 1, is intended to be attached to both the transom attachment member 36 and the drive unit 34 when the transom attachment member 36 is assembled into the opening 40 formed in the transom 20.

With continued reference to FIG. 6, the transom plate 60 is shown attached to the transom attachment member 36 by bolts 82. Also shown in FIG. 6 is an axis of rotation 84 about which a crankshaft of the engine 32 and a driveshaft within the drive unit 34 are supported for rotation. The opening identified by reference numeral 86 is shaped to receive the driveshaft which rotates about the axis of rotation 84. Opening 88 is an exhaust conduit through which exhaust gases pass from the engine 32 into the drive unit 34.

With continued reference to FIG. 6, it can be seen that the transom attachment member 36 is shaped to receive a portion of the transom 20 within a shaped edge portion of the transom attachment member 36. The extension 90 of the transom attachment member 36 is shaped to be larger than the width of the opening 40 at each relevant corresponding vertical position when the transom attachment member 36 is placed in contact with the transom 20. This portion 90 prevents the transom attachment member 36 from moving through the opening 40 in a direction toward the engine 32 (i.e. downwardly in FIG. 6) when the transom attachment member 36 is placed in its position relative to the transom 20. The transom plate 60 cooperates with this portion 90 of the transom attachment member 36 to contain the edge of the opening 40 within the resulting channel formed by these two components. When the transom plate 60 is rigidly attached to the transom attachment member 36, such as by bolts 82, the transom 20 is captured between the transom plate 60 and the extension portion 90 of the transom attachment member 36. This holds the marine propulsion system in place relative to the transom 20.

Figure 7:
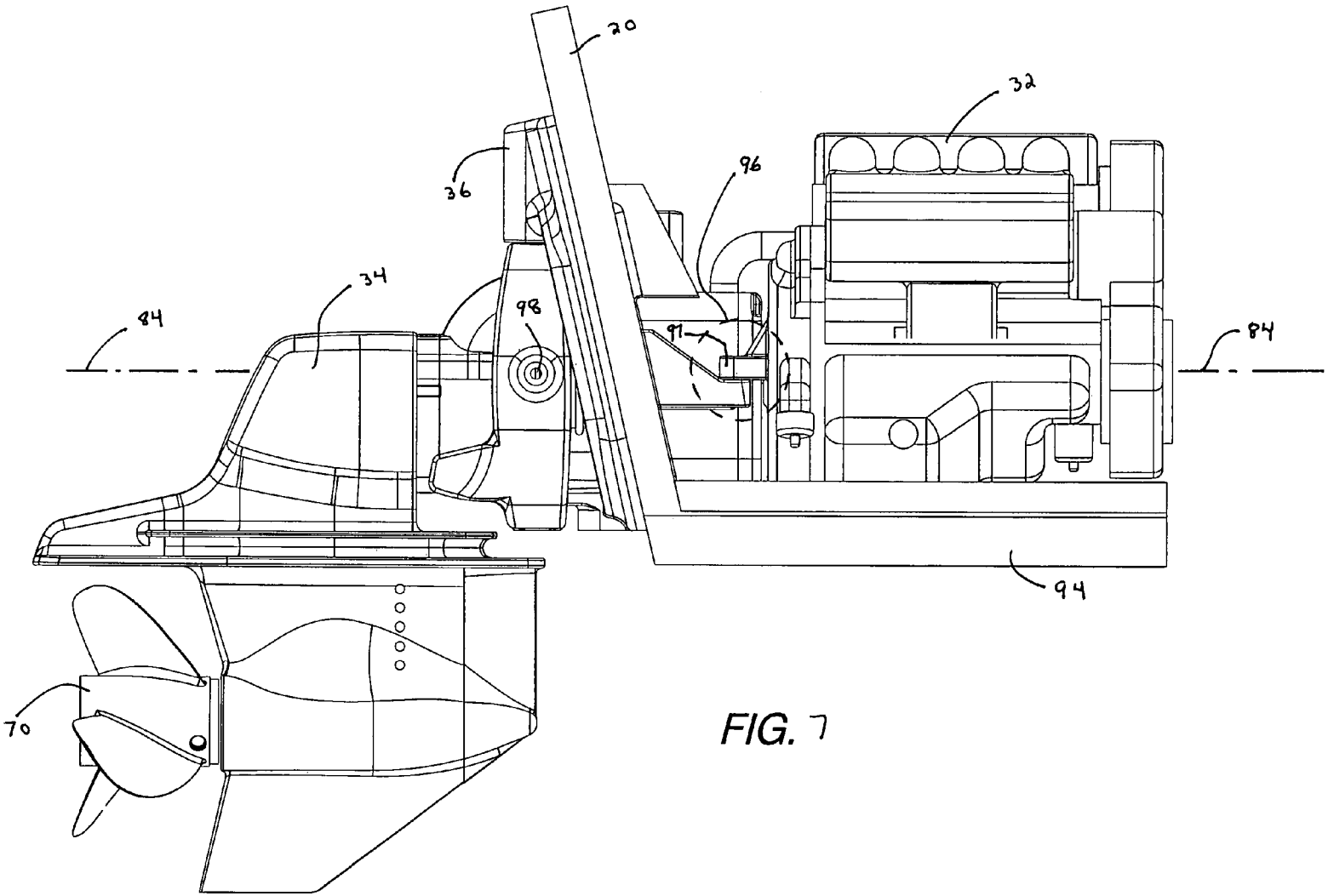
FIG. 7 is a side view of a marine propulsion system made in accordance with a preferred embodiment of the present invention.

FIG. 7 is a side view of an aft portion of a marine vessel incorporating the present invention. After the transom attachment member 36 is lowered into position relative to the transom 20 and its opening 40, as described above in conjunction with FIG. 1, the engine is rigidly attached to the hull 94 of the marine vessel and the transom attachment member 36 is rigidly attached to the transom 20, as described above in conjunction with FIG. 6. The engine 32 is rigidly attached to the transom attachment member 36 at the location shown within the dashed line circle 96. A trim axis 98 is shown in FIG. 7. In a preferred embodiment of the present invention, it intersects the center line 84 about which the crankshaft of the engine 32 and the driveshaft of the drive unit 34 are supported for rotation.

Figure 8:
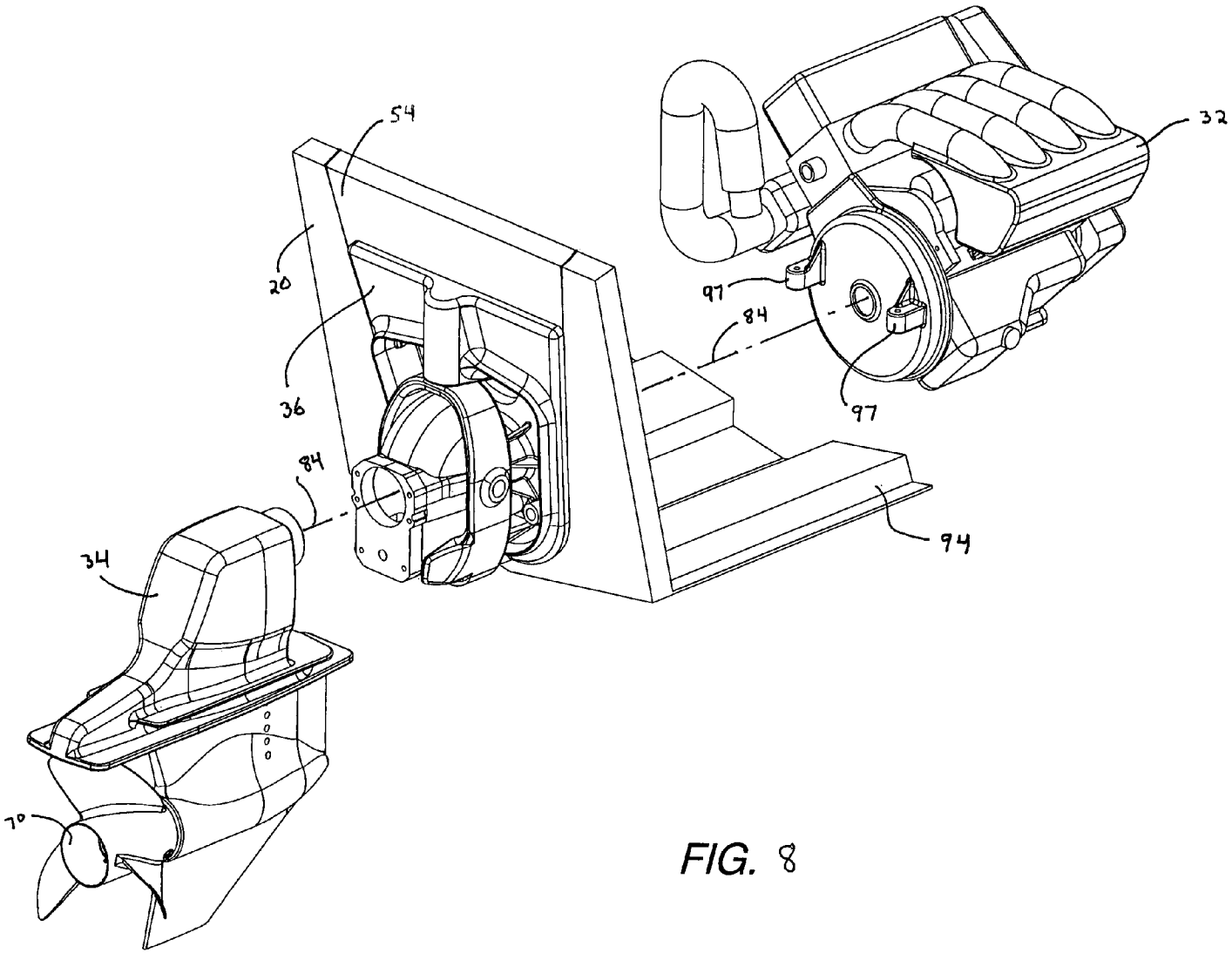
FIG. 8 is an exploded view of the structure illustrated in FIG. 7.

FIG. 8 is an exploded view intended to show the individual components of the marine propulsion system. However, it should be understood that assembly of the marine propulsion system, in accordance with a preferred embodiment of the present invention, to a marine vessel occurs with the associated components attached to each other. In other words, the engine 32 and the drive unit 34 are rigidly attached to the transom attachment member 36 prior to it being lowered into position within the opening formed in the transom 20. The purpose of the exploded view shown in FIG. 8 is to illustrate that, prior to preassembly, the engine 32, the drive unit 34, and the transom attachment member 36 are individual components that are attached to each other to form the marine propulsion system. This marine propulsion system, after attachment of the individual portions to each other, is then lowered into position within the marine vessel as described above. The components in FIG. 8 are illustrated with the axis of rotation 84 which is intended to represent the alignment of a crankshaft of the engine 32 with a driveshaft of the drive unit 34. The two feet, identified by reference numeral 97 in FIG. 8, form a portion of the attachment mechanism 96 described above in conjunction with FIG. 7.

The present invention provides several significant advantages. One advantage relates to the fact that the engine, drive unit, and transom attachment member can be preassembled at the factory where the marine propulsion unit is manufactured. Because of this, the important dimensions between components on the engine, components on the transom attachment member, and components on the drive unit can be maintained more accurately. These dimensions are not changed during the shipping and subsequent assembly in a marine vessel since the major components of the marine propulsion system need not be separated after initial assembly. Another advantage of the present invention is that the marine propulsion system can be tested as a completed unit at the manufacturer's location. The engine can be tested as it drives the rotatable shafts of the drive unit. After the completed marine propulsion system is tested, it remains assembled as it is shipped to the boat builder for installation into a marine vessel. Another advantage provided by the present invention is that the assembly time at the boat builder's location is significantly reduced since the engine, the transom attachment member, and the drive unit need not be attached together during the assembly into the marine vessel and all necessary alignments and calibrations have been completed at the manufacturer's location and need not be redone. At the boat builder's location, the entire preassembled marine propulsion system is lowered into its position in a marine vessel and attached to the marine vessel. This process significantly reduces the time and cost necessary to install a marine propulsion system in a marine vessel.

With reference to FIGS. 1–8, it can be seen that the present invention provides a method for installing a marine propulsion system 30 in a marine vessel 10. That method comprises the steps of providing an engine 32, providing a drive unit 34, and providing a transom attachment member 36. It also comprises the step of connecting the engine 32 and the drive unit 34 to the transom attachment member 36 and then attaching the transom attachment member 36 to the transom 20 of a marine vessel 10 subsequent to the connecting step. In other words, the engine 32 and the drive unit 34 are first connected to the transom attachment member 36 and then the entire assembly is lowered into position in order to attach the transom attachment member 36 to the transom 20 of the marine vessel 10. The attaching step is performed while the engine 32 and the drive unit 34 remain connected to the transom attachment member 36.

Although the present invention has been described with particular specificity and illustrated to show a particularly preferred embodiment, it should be understood that alternative embodiments are also within its scope.

We claim:

1. A marine propulsion stern drive system for propelling a marine vessel in a forward direction, said marine vessel having an aft transom, comprising:

an engine forward of said transom;

a drive unit aft of said transom and driven by said engine;

a U-shaped notch in said transom, said U-shaped notch having a lower bight and a pair of sidewalls extending upwardly therefrom;

a transom attachment member received in said U-shaped notch and attached to said transom, wherein said engine and said drive unit are attached to said transom attachment member, wherein said transom has an upper edge, and said U-shaped notch extends downwardly through said upper edge such that said upper edge has gap therealong, said gap extending between said sidewalls, and comprising a cap closing said U-shaped notch and extending between said sidewalls and spaced above the attachment of said engine and said drive unit to said transom attachment member.

2. The marine propulsion stern drive system according to claim 1 wherein said cap extends along said upper edge of said transom across said gap.

3. The marine propulsion stern drive system according to claim 2 comprising a filler piece in said U-shaped notch between said transom attachment member and said cap, namely above said transom attachment member and below said cap.

4. A marine propulsion stern drive system for propelling a marine vessel in a forward direction, said marine vessel having an aft transom, comprising:

an engine forward of said transom;

a drive unit aft of said transom and driven by said engine;

a U-shaped notch in said transom, said U-shaped notch having a lower bight and a pair of sidewalls extending upwardly therefrom, said transom having an upper edge, said U-shaped notch extending downwardly through said upper edge such that said upper edge has a gap therealong, said gap extending between said sidewalls;

a transom attachment member received in said U-shaped notch and attached to said transom, wherein said engine and said drive unit are attached to said transom attachment member and respectively have a crankshaft and a driveshaft extending along a fore-aft axis of rotation extending through an opening in said transom attachment member, which opening is spaced below said upper edge of said transom, and said transom attachment member is accessible through and removable through said gap at said upper edge of said transom while said engine and said drive unit remain attached to said transom attachment member.

5. The marine propulsion stern drive system according to claim 4 wherein said engine and said drive unit and said transom attachment member comprise a pre-assembled unit received in said U-shaped notch and installable as a unit into said U-shaped notch downwardly through said gap at said upper edge of said transom, and removable as a unit from said U-shaped notch upwardly through said gap at said upper edge of said transom.

* * * * *